United States Patent [19]

Seregely

[11] 4,266,459

[45] May 12, 1981

[54] ASYNCHRONOUS SLAPPING MUSICAL INSTRUMENT

[76] Inventor: Daniel W. Seregely, 2432 22nd St., Santa Monica, Calif. 90405

[21] Appl. No.: 63,424

[22] Filed: Aug. 3, 1979

[51] Int. Cl.[3] ..... G10D 13/06

[52] U.S. Cl. ..... 84/402; 46/191

[58] Field of Search ..... 46/191; 84/402, 408; 416/73

[56] References Cited

U.S. PATENT DOCUMENTS

| | | | |
|---|---|---|---|
| 4,019,277 | 4/1977 | Kenkelen | 46/175 R |
| 4,075,922 | 2/1978 | Smith | 84/402 |

FOREIGN PATENT DOCUMENTS

| | | | |
|---|---|---|---|
| 3801 | 4/1901 | Austria | 46/191 |

*Primary Examiner*—Lawrence R. Franklin

*Attorney, Agent, or Firm*—Poms, Smith, Lande & Rose

[57] ABSTRACT

A musical instrument for producing slapping sounds occurring at an audibly distinct asynchronous rate. A rigid slat member has a plurality of flexible slat members disposed adjacent thereto on at least one side and connected at one end to form a gripping handle. The flexible slats are increasingly weighted away from the rigid slat member such that when the rigid slat is rapidly accelerated through a swinging motion by gripping the handle the outermost slats will be flexed a greater distance than the inner slats. Consequently, the time for unflexing when the swinging has stopped is greater for the outer flexible slats whereby they strike in a slapping motion at a sufficiently delayed time to be audibly distinguishable.

1 Claim, 5 Drawing Figures

ASYNCHRONOUS SLAPPING MUSICAL INSTRUMENT

BACKGROUND OF THE INVENTION

The present invention relates to percussion type musical instruments and, more particularly, to instruments for producing a slapping sound.

Instruments for use in producing a slapping sound are used both professionally and as toys. Typical examples well known in the art are shown as FIGS. 1, 2, and 3. For example, in FIG. 1, the instrument 10 comprises a pair of slats 12 held in parallel spaced relationship by a handle 14 as shown in the ghosted position. By gripping the handle 14 and rotating the instrument 10 back and forth as indicated by the arrow 16, as for example against the side of a hand 18, a slapping sound can be created. Each time the instrument 10 is struck against the hand 18, a single slap is produced. The frequency or pattern of the slapping sounds is very varied by varying the rate or time of rotation.

In yet another example as shown in FIG. 2, the instrument 20 comprises a pair of resiliently flexible slates 22 disposed on either side of a rigid slat 24 by handle 26. As the instrument 20 is rotated as indicated by the arrow 28 the resiliently flexible slats are alternately rotated away from the rigid slat 24 as indicated by the arrows 30 to the ghosted position and thereafter return to slap against the rigid slat 24. The slapping sound produced by the instrument 20 is a regular sound of a fixed frequency determined by the rate of rotation alternations.

A well-known so-called "noisemaker" instrument used commonly at parties, Halloween, New Year's celebrations, and the like is shown in FIG. 3. The noisemaker 32 comprises a metal pan 34 attached to a handle 36. A pair of elongated spring steel wires 38 are connected to the handle on one end and have wooden balls 40 attached to the opposite end on either side of the bottom of the pan 34. As the metal pan is shaken in an alternating rotation motion as indicated by the arrow 42, the wooden balls flex the wires 38 to the ghosted positions and return to strike the metal pan 34 to create a loud clanging sound. As with the instrument 20 of FIG. 2, however, the noisemaker 32 creates a regular sound of varying frequency depending upon the rate at which the instrument is shaken by the handle 36.

Often times, particularly in percussion accompaniment to musical selections, it is desirous to produce an asynchronous sound. To attempt to use an instrument such as that of FIG. 1 with any regularity or complicated nature to the sound is difficult to virtually impossible. Wherefore, it is the object of the present invention to provide a musical instrument producing slapping sounds of an asynchronous nature which have the potential for being relatively complex but repeatable in a manner which is easily accomplished over a long duration.

SUMMARY

The foregoing objective has been accomplished by the musical instrument of the present invention for producing asynchronous slapping sounds comprising a rigid slat member; and, a plurality of resiliently flexible slat members disposed adjacent at least one side of said rigid slat member and connected thereto on one end to form a handle portion for gripping, the flexible slat members having the masses thereof concentrated and the flexing characteristics provided such that each of the flexible slat members flexes further than the next adjacent of the flexible slat members closer to the rigid slat member in response to equal accelerations normal to the rigid slat member such that when the flexible slat members are flexed by an acceleration of the rigid slat member by the swinging thereof the flexible slat members will take differing times to unflex when the swinging has stopped to thereby slap against the rigid slat member and the more inner ones of the flexible slat members at times delayed from one another sufficiently to create an audibly distinguishable asynchronous slapping sound.

DESCRIPTION OF THE PREFERRED EMBODIMENT

Figure 1:
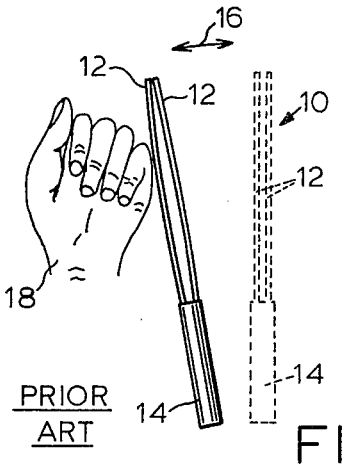
FIGS. 1–3 are simplified drawings of prior art percussion musical instruments performing in a manner similar to that of the present invention.
Figure 2:
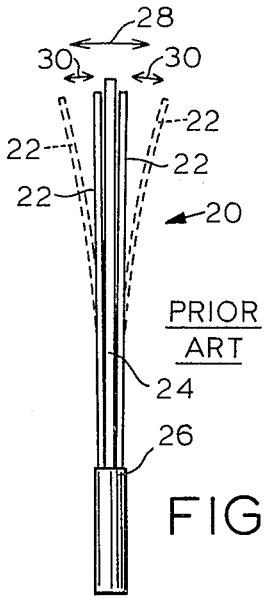
Figure 3:
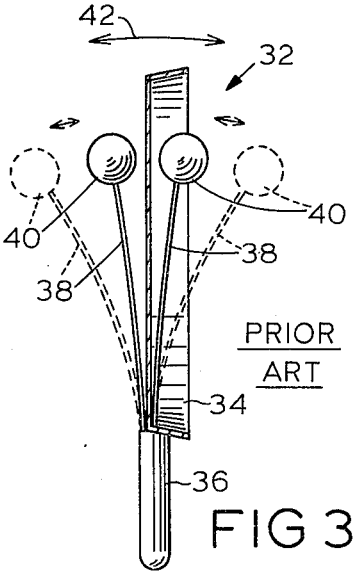
Figure 5:
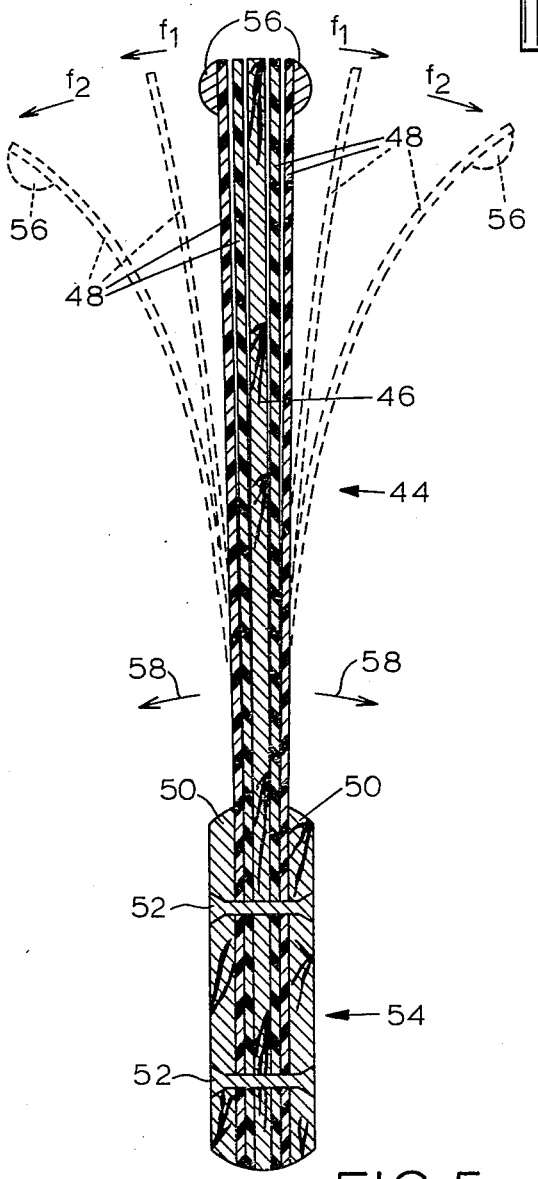
FIG. 5 is a cut-away side elevation of the instrument of FIG. 4 in the plane V—V.
Figure 4:
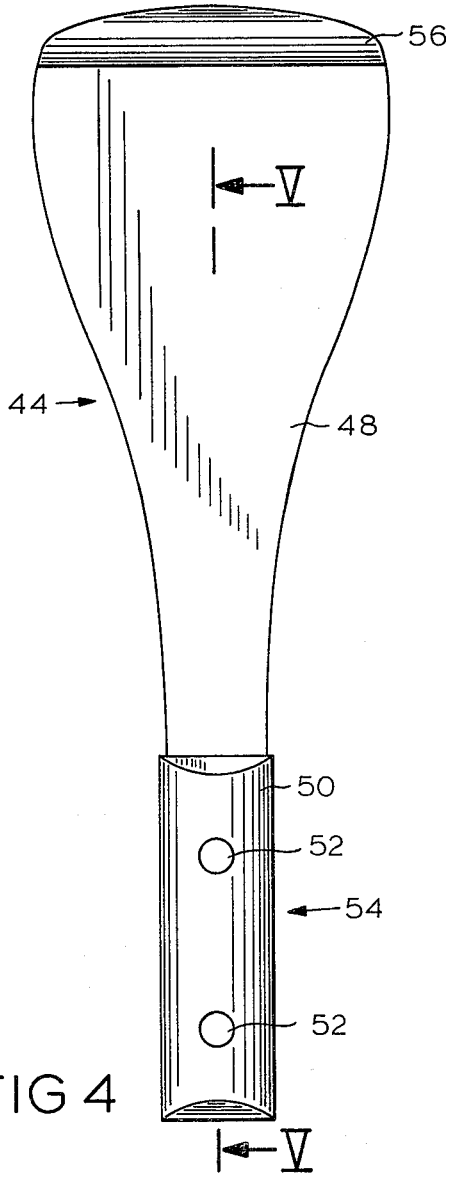
FIG. 4 is a front view of the musical instrument of the present invention.

Referring now to FIGS. 4 and 5, the preferred embodiment of the present invention is shown. The instrument, generally indicated as 44, comprises a rigid slat member 46 having two pairs of substantially identical resiliently flexible slat members disposed with two on either side of member 46. The members 46, 48 are clamped together between two handle members 50 as with rivets 52 to form a handle portion generally indicated as 54. In a tested embodiment of the present invention, rigid slat member 46 and handle members 50 were made from one-fourth inch plywood and resiliently flexible slat members 48 were made from 3/32-inch thick polyethylene plastic. The two outermost slat members 48 have metallic weights 56 attached on the outside thereof on the end furthest from handle portion 54.

As can be seen with particular reference to FIG. 5, if the handle portion 54 is gripped and the instrument rotated in the direction of arrows 58 in a reciprocal manner, the flexible slat members 48 on opposite sides of the rigid slat member 46 will be subjected to alternate equal accelerations. Since the force imparted is equal to the mass times the acceleration, with equal accelerations, the flexible slat members 48 are subjected to differing flexing forces due to the addition of the metallic weights 56 (e.g. mass). Thus, as shown in the ghosted positions, forces $f_1$ will flex the inner flexible slat members 48 a given amount while the greater force $f_2$ will flex the outer flexible slat members 48 a much greater amount. Consequently, as the swinging is stopped, the resilient flexible slat members 48 which have been flexed will tend to resume their position against the rigid slat member 46. Having been flexed considerably further, however, the outer slat member 48 will take an additional time to reach and strike the inner flexible slat member 48 and rigid slat member 46 which is sufficient to be audibly discernible. Thus, as the instrument 44 is oscillated, an audibly distinguishable asynchronous slapping sound will be created.

While the embodiment described above is shown with two pairs of resiliently flexible slat members 48, more complex asynchronous slapping patterns can be created by adding additional flexible slat members 48 on either side. Each succeedingly outward flexible slat member 48 in such case is weighted or otherwise caused to flex a greater amount than the next more interior member 48 to cause the audibly distinguishable time delay discussed above.

It should be understood that the time delay can be caused additionally by changing the flexing characteristics each flexible slat member 48. That is, in the preferred embodiment as shown, the flexible slat members 48 (and for aesthetic reasons the rigid slat member 46 as well) are tapered towards the handle portion 54 in width. This causes the mass to be concentrated further from the handle and the portion closer to the handle to be more flexible. This same technique of construction or others such as providing thinner portions, etc. could be employed to create the variable flexing in response to equal accelerations described above and are considered to be within the scope and spirit of the present invention as specifically described herein.

Wherefore, having thus described my invention, I claim:

1. A musical instrument for producing asynchronous slapping sounds comprising:

(a) a rigid slat member;

(b) a pair of first resiliently flexible slat members disposed one on each side of said rigid slat member close adjacent thereto and connected to said rigid slat member on one end to form a handle portion for gripping;

(c) a pair of second resiliently flexible slat members substantially identical to said first flexible slat member disposed one on each side of said first flexible slat members away from said first slat members and close adjacaent thereto and connected to said first flexible slat members on the ends thereof connected to said rigid slat member to form said handle portion; and (d) a pair of weights attached to respective ones of said second flexible slat members adjacent the ends thereof opposite said handle portion whereby said first and second flexible slat members flex unequally in response to equal swinging forces imparted to said handle to thereafter unflex and to strike said rigid slat member at times delayed from one another sufficient to create an audibly distinguishable asynchronous slapping sound.

* * * * *